US005898450A

United States Patent [19]

Ahn

[11] Patent Number: 5,898,450

[45] Date of Patent: Apr. 27, 1999

[54] INK CARTRIDGE FOR INK JET PRINTER HAVING EASY INK SUPPLEMENTING FUNCTION

[75] Inventor: Byung-Sun Ahn, Kyungki-do, Rep. of Korea

[73] Assignee: SamSung Electronics Co., Ltd., Kyungki-do, Rep. of Korea

[21] Appl. No.: 08/805,384

[22] Filed: Feb. 24, 1997

[30] Foreign Application Priority Data

Feb. 24, 1996 [KR] Rep. of Korea ..... 96-4534

[51] Int. Cl.[6] ..... B41J 2/175

[52] U.S. Cl. ..... 347/87; 347/85

[58] Field of Search ..... 347/29, 85, 86, 347/87; 53/86; 222/130

[56] References Cited

U.S. PATENT DOCUMENTS

| | | | |
|---|---|---|---|
| 3,949,707 | 4/1976 | Armstrong et al. | 119/73 |
| 4,515,463 | 5/1985 | Plumadore | 355/10 |
| 5,017,951 | 5/1991 | De Prijcker et al. | 355/27 |
| 5,126,767 | 6/1992 | Asai | 327/86 |
| 5,275,310 | 1/1994 | Mielnik et al. | 222/130 |
| 5,356,037 | 10/1994 | Harrold | 222/95 |
| 5,531,055 | 7/1996 | Sell et al. | 53/86 |
| 5,682,186 | 10/1997 | Bohorquez et al. | 347/29 |

FOREIGN PATENT DOCUMENTS

| | | | |
|---|---|---|---|
| 6-106729 | 4/1994 | Japan | B41J 2/175 |

*Primary Examiner*—N. Le
*Assistant Examiner*—Anh T. N. Vo
*Attorney, Agent, or Firm*—Robert E. Bushnell, Esq.

[57] ABSTRACT

An ink cartridge for ink jet printers having an easy ink-complementing function that includes a reservoir for storing ink, an opening plate for controlling the drop-size of ink, an ink reserving elastic member disposed in the reservoir to reserve and feed ink, a cap for capping the reservoir, and a supplemental ink overflow preventing unit placed within the cap. The overflow preventing unit has an injection hole, and makes it possible to identify the supplemental ink overflowing around the injection hole and to automatically inject the overflow ink by self-gravity.

17 Claims, 3 Drawing Sheets

INK CARTRIDGE FOR INK JET PRINTER HAVING EASY INK SUPPLEMENTING FUNCTION

CROSS REFERENCE TO RELATED APPLICATION

This application makes reference to, incorporates the same herein, and claims all benefits accruing under 35 U.S.C. §119 from applications for INK CARTRIDGE FOR INK JET PRINTER HAVING EASY INK SUPPLEMENTING FUNCTION earlier filed in the Korean Industrial Property Office on Feb. 24, 1996, and there duly assigned Ser. No. 96-4534.

BACKGROUND OF THE INVENTION

1. Field of the Invention

The present invention relates generally to an ink cartridge for ink jet printers. More particularly, the present invention relates to an ink cartridge having an easy ink supplementing function when the supplemental ink is injected into the ink cartridge.

2. Discussion of Related Art

Typically, an ink jet printer is used to print characters or pictures on a plain paper by jetting ink. It uses an ink cartridge to jet ink. Exemplars of the contemporary practice include De Pricjcker et al. (U.S. Pat. No. 5,017,951, *Photographic Processing Application With Replaceable Cassette*, May 21, 1991) discussing a photographic image-forming apparatus with replaceable cassette including an exposure station. Inside a developing station, a silver halide developer liquid is applied to the imagewise exposed element. Mielnik et al. (U.S. Pat. No. 5,275,310, *Vented, Non-reusable, Multi-dose Cartridge*, Jan. 4, 1994) discusses a vented cartridge including a container having a top surface, a bottom surface, and side surfaces connected together to define a predetermined volume. A vent tube extends from the top surface and is positioned coaxially with the dip tube. An upper valve is positioned at the upper opening for closing the upper opening when the cartridge is oriented with the top surface facing down. A lower valve is positioned at the lower opening for closing the lower opening when the cartridge is oriented with the top surface facing up.

Harrold (U.S. Pat. No. 5,356,037, *Lift And Drop Ratchet Stick Dispenser*, Oct. 18, 1994) discusses a dispenser for liquids or solids. It includes a main hollow housing with side walls, an open base and an open top. A portion of the housing is tapered downwardly so as to permit upward movement and restrict downward movement of a displacable plate located within the housing. Plumadore (U.S. Pat. No. 4,515, 463, *Inclined Toner Flow Control System For Developing An Electrostatic Latent Image Upon An Electrophotographic Film*, May 7, 1985) discusses a toner control system for liquid toner within a camera and processor apparatus. The film and electrode define a toner flow channel therebetween, whereby the flow of the liquid toner through the channel is able to be controlled and uniformly distributed over the electrode and film. In addition, gravity discharge of the toner from the channel is able to be accomplished without the need for special sealing devices to confine the toner within the toner cell. The controlled flow of the toner within the channel eliminates the need for substantial negative pressure or vacuum suction systems normally employed in conjunction with vertically oriented toner channels. From my study of these exemplars of the contemporary art, I find that there is a need for an improved and effective ink cartridge in which even when ink overflows, the ink does not externally run over but is sent into the ink cartridge.

SUMMARY OF THE INVENTION

Accordingly, an object of the present invention is to provide an improved ink cartridge and process of dispersing ink from cartridges with ink jet printers.

Another object is to provide an improved ink cartridge having an easy ink supplementing function and process when the supplemental ink is injected into the ink cartridge.

Another object is to provide an ink cartridge and process in which even when ink overflows, the ink does not externally run over but is sent into the ink cartridge.

Another object is to provide an ink cartridge and process in which it is possible to identify the ink-supplementational state so that the amount of injected ink can be controlled, and even when the supplemental ink overflows, the overflow ink does not externally run over but is again injected into the ink cartridge.

A further object is to provide an ink cartridge and process in which it is possible to identify the ink-supplementing state so that the amount of injected ink can be controlled, and even when the supplemental ink overflows, the overflow ink does not externally run over but is again injected into the ink cartridge by its self-gravity.

Another object is to provide an ink cartridge and process in which even when the supplemental ink overflows, the overflow ink does not externally run over but is again injected into the ink cartridge while keeping the conventional size of the ink cartridge.

Another object is to provide an ink cartridge and process in which the supplemental ink is easily injected and does not externally run over while a total size of the ink cartridge is not larger or smaller than the existing one. When the size of the ink cartridge is different from the existing one, a carriage for moving the ink cartridge from the printer, a driver for driving the carriage, etc. likely would be structurally changed at additional cost.

To achieve these or other objects, an ink cartridge according to the principles of the present invention includes a reservoir for storing ink. A jetting unit is disposed under the bottom of the reservoir and connected with a head driver by an electric connector to jet ink. An opening plate controls the size of ink drops. An ink reserving elastic member is disposed in the reservoir to reserve and feed ink. A cap caps the reservoir. An supplemental ink overflow preventing unit is disposed in the cap. The supplemental ink overflow preventing unit is placed within the cap such that the inventive ink cartridge keeps the conventional size. The supplemental ink overflow preventer has an injection hole, makes and it possible to identify the supplemental ink overflowing around the injection hole and to automatically inject the overflow ink by its self-gravity. The supplemental ink overflow preventer also further includes a guide tube directed toward the lower space of the cap from the top thereof to guide an injection tube of an ink injector, and an overflow ink chamber surrounded with the guide tube to temporarily store the overflowing ink.

It is to be understood that both the foregoing general description and the following detailed description are exemplary and explanatory and are intended to provide further explanation of the invention as claimed.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENT

Reference will now be made in detail to the preferred embodiments of the present invention, examples of which are illustrated in the accompanying drawings.

Figure 1:
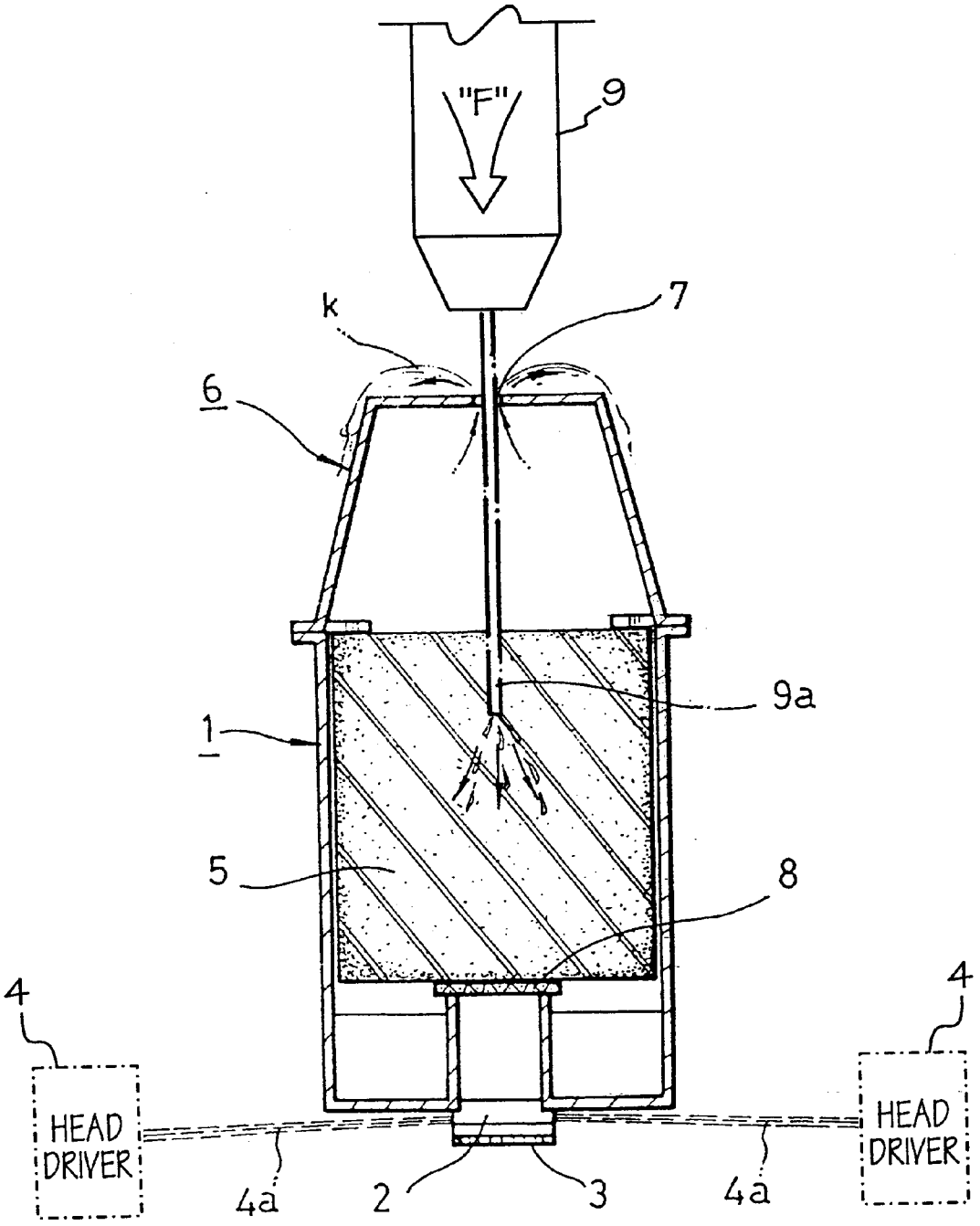
FIG. 1 is a cross-sectional view of a contemporary ink cartridge.

FIG. 1 shows a composition of the ink cartridge jetting ink, as used in the ink jet printer. The ink cartridge has a reservoir 1 for storing ink. The ink cartridge includes a jetting unit 2 disposed under the bottom of the reservoir 1 to jet ink, an opening plate 3 for controlling the drop-size of ink, a head driver 4 connected to the jetting unit 2 by an electric connector 4*a* to feed energy necessary for jetting ink in accordance with data received in a video board of the printer from the computer, an ink reserving elastic member 5 disposed in the reservoir 1 to reserve and feed the ink, a cap 6 installed on the top of the reservoir 1 to cap it, and an injection hole 7 formed on the top of the cap 6 to be used for injecting ink.

When data is transmitted to the video board of the printer from a computer, the head driver 4 gives energy to a heating part of the latter, in accordance with the data. As noted before, the head driver 4 is electrically connected to the jetting unit 2 by the electrical connector 4*a*. Then, the heating part is heated so that ink evaporates. This evaporation causes ink to be jetted through the opening of the plate 3. The jetting ink forms characters or pictures on the plain paper conveyed from the paper storage cassette in a dot-matrix format. The ink reserved in the ink reserving elastic member 5 is fed into the heating part of the jetting unit 2 through the filter 8 of the reservoir 1. When any given quantity of ink is exhausted, printing inferiority and omission of portions of characters and images occur due to the lack of ink.

Therefore, when a printing omission occurs due to a lack of ink, the user may inject the supplemental ink into the ink cartridge to thereby resume the normal printing. During this injection, an ink injector may be used for supplementing the ink. The ink injector 9 has a form of injector and is provided with an injection tube 9*a* like a needle. It deeply injects the injection tube through the injection hole 7 formed on the cap 6 of the ink cartridge and applies the injection pressure so that the supplemental ink can be injected into the ink reserving elastic member 5. Since the ink cartridge is usually manufactured as a opaque body, the feeding and fluctuating state of the supplemental ink injected into the reservoir 1 cannot be externally seen during the ink supplementation.

Meanwhile, the supplemental ink can run over through the injection hole 7 to the exterior. The supplement ink can be in excess of the ink storage quantity being capable of being received in the ink reserving elastic member. In that case, hands or clothes of the user may be spoiled, and the surrounding environment can be contaminated. In particular, since the ink cartridge has a relatively small size, the ink supplementation is usually performed by hand so that when the ink overflows through the injection hole 7, the overflow begins while the ink injection power is applied to the ink injector, and a large quantity of ink can overflow so that clothes of the user can be inevitably spoiled. Thus, it is likely the consumer-user frequently complains about the ruined clothes!

Figure 2:
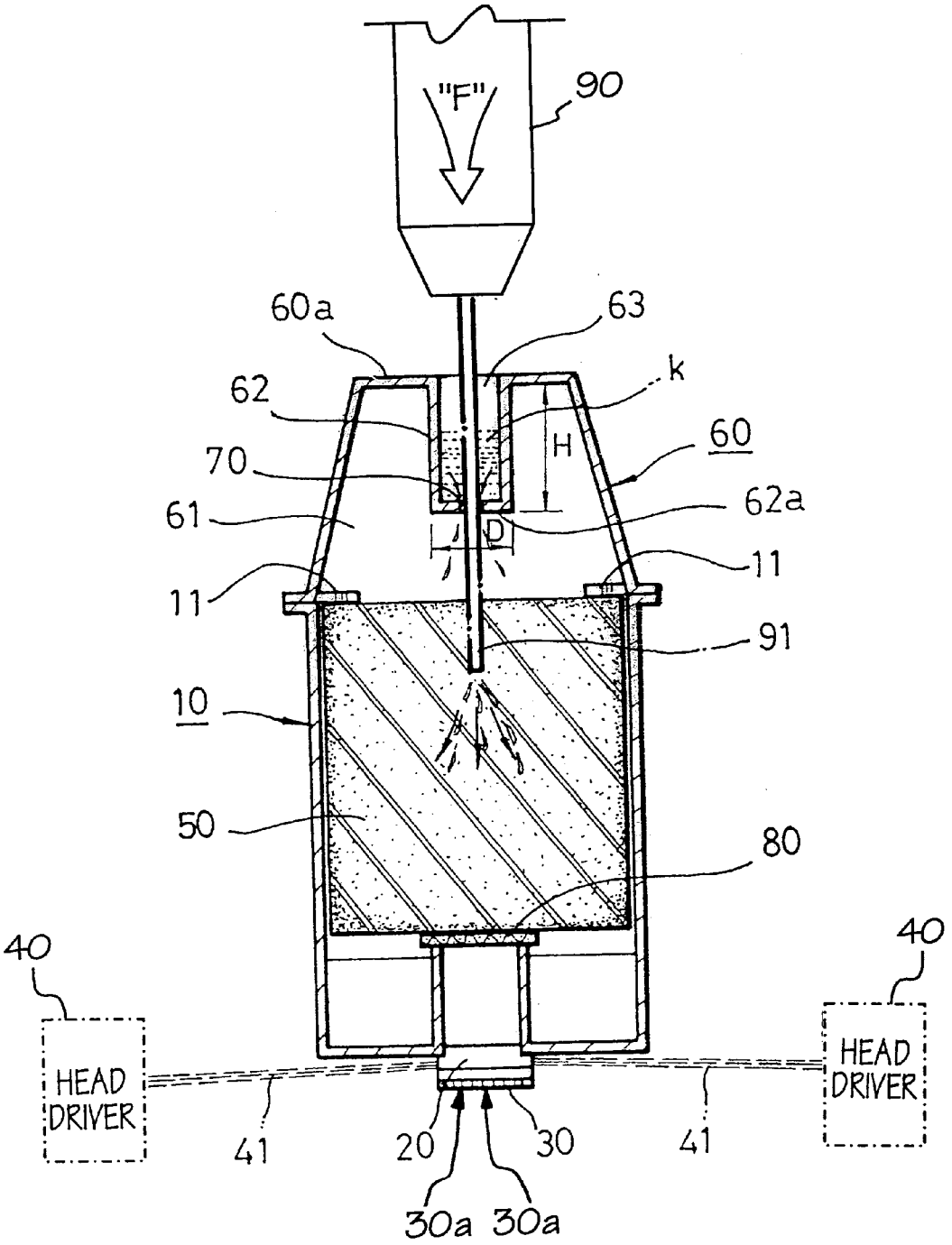
FIG. 2 is a cross-sectional view of a ink cartridge constructed according to the principles of the present invention.
Figure 3:
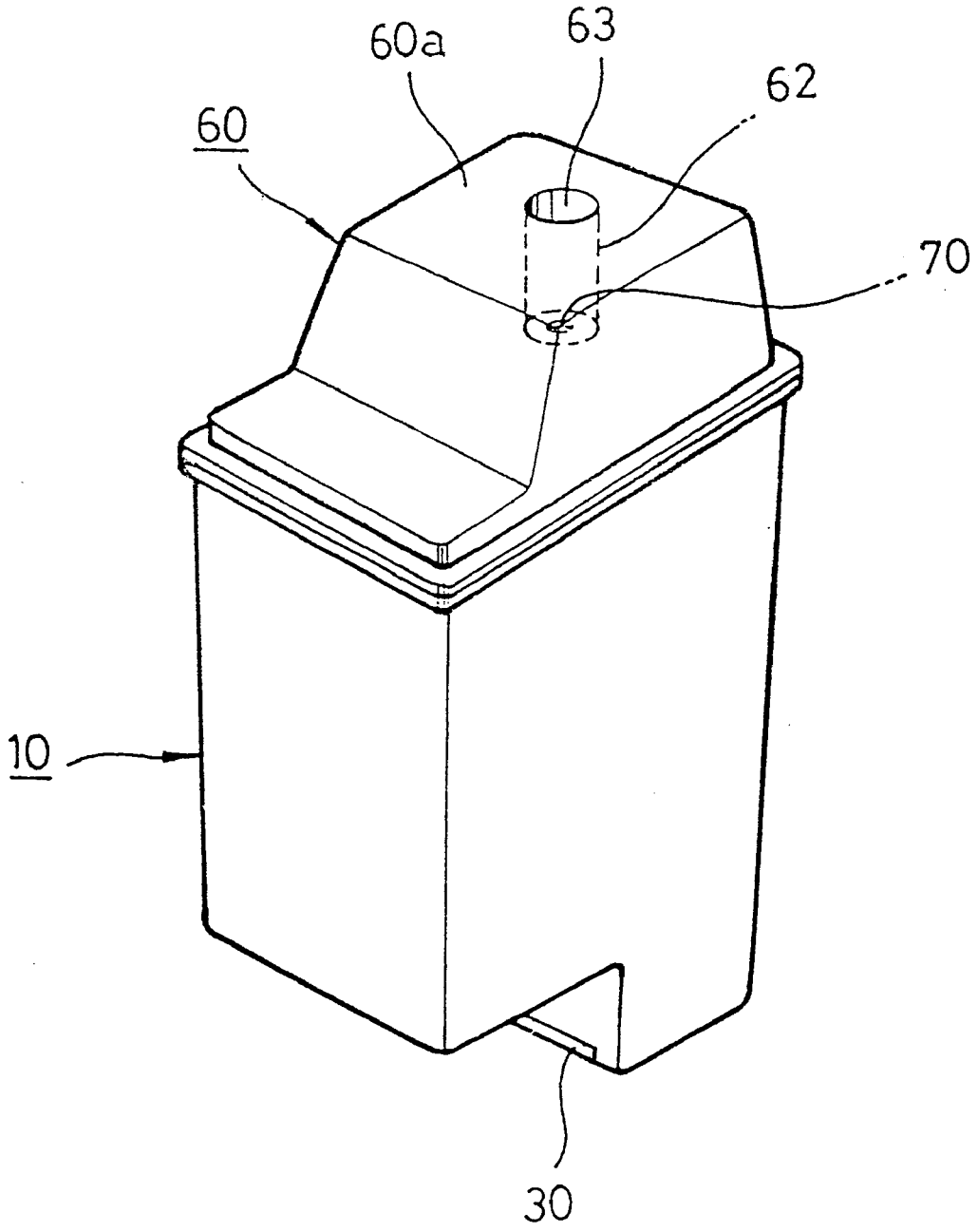
FIG. 3 is a perspective view of an another ink cartridge constructed according to the present invention.

As illustrated in FIGS. 2 and 3, there is illustrated a better way according to present invention. As illustrated in FIGS. 2 and 3, an ink cartridge is provided with a reservoir 10 for storing ink, a jetting unit 20 disposed under the bottom of the reservoir 10 and connected with a head driver 40 by an electric connector 41 to jet ink, and an opening plate 30 having at least one opening 30*a* for controlling the drop-size of ink. The head driver 40 is connected to the jetting unit 20 by the electric connector 41, and feeds electrical energy necessary for jetting ink to the latter on the basis of data received in a video board of the printer from the computer. An ink reserving elastic member 50 is provided within the reservoir 10 to reserve and feed ink. The ink, fed into the jetting unit 20 from the ink reserving elastic member 50, passes through a filter 80. Furthermore, the ink reserving elastic member 50 disposed in the reservoir 10 is provided with a compression rib 11 which prevents the ink reserving elastic member 50 from being blown up due to the ink feeding while applying pressure to reservoir 10 to properly feed ink to the jetting unit 20. A cap 60 is installed on the top of the reservoir 10 to cap reservoir 10. The cap 60 has an inner space 61 in which a supplemental ink overflow preventing unit is disposed.

This supplemental ink overflow preventer or preventing unit extends toward the inner space 61 from the top 60*a* of the cap 60. The supplemental ink overflow preventer is provided with a guide unit 62 for guiding an injection tube 91 of the ink injector 90. An injection hole or aperture 70 is formed on the bottom 62*a* of the guide unit 62 to receive the injection tube 91 of the ink injector 90. An overflow ink chamber 63 is formed on the upper side of the injection hole 70 to be externally exposed. Thus, the overflow ink chamber 63 can be seen from the outside. Of the cap 60 size of the ink cartridge is not changed because the chamber 63 is placed within the inner space 61. The overflow ink chamber 63 is advantageously formed having a height H larger than its width or diameter D.

Therefore, when the computer transmits data to a video board of the printer, a heating part of the jetting unit 20 is controlled to be heated by the head driver 40. The jetting unit 20 is controlled in accordance with the data so that ink is evaporated. The evaporation causes ink to be jetted through the opening plate 30. The jetting ink forms characters or pictures on the plain paper conveyed from the paper storage cassette in a dot matrix format. The ink, reserved in the ink reserving elastic member 50, is fed into the heating part of the jetting unit 20 through the filter 80 by the negative pressure caused by the discharge of ink. Thus, when any given quantity of ink is exhausted, the printing inferiority and omission is generated due to the lack of ink. If this phenomenon occurs, ink is supplemented in the reservoir 10 using the ink injector 90.

As illustrated in FIG. 2, the injection tube 91 of the ink injector 90 is inserted into the injection hole 70 through the overflow ink chamber 63. At this time, the guide unit 62 has a role of guiding the injection tube 91. Also, when the supplemental ink leaks in the process prior to inserting the injection tube 91 into the injection hole 70, that ink drops into the overflow ink chamber 63 so that leakage of ink and contamination can be prevented.

When the injection tube 91 of the ink injector 90 is inserted into the ink reserving elastic member 50 disposed in the reservoir 10 through the injection hole 70, injection power F is applied to the ink injector 90 so that ink begins injecting. The supplemental ink is injected into the ink reserving elastic member 50, composed of a suction material, through the injection tube 91. When the supplemental ink is injected, the injection speed is changed in proportion to the injection power applied to the ink injector 90 while the amount of injection ink differentiates in accordance with the change of the injection speed. When the injection tube 91 is somewhat inserted into the ink reserving elastic member 50 and the injection power is strong, the supplemental ink is rapidly injected into the elastic member. At this time, the amount of injected ink can be larger than the suction quantity of the ink reserving elastic member 50. When the supplemental ink is continuously injected at that state, the inner space 61 of the cap 60 is filled with ink so that the ink can externally overflow through the injection hole 70.

When ink leaks out through the injection hole 70 in accordance with the ink overflowing, the overflow ink flows into the overflow ink chamber 63. Since the overflow ink chamber 63 opens such that the user can see its inner space from the outside, the user can easily identify the leakage state of the supplemental ink. Thus, the user identifies the overflow ink leaked through the injection hole 70 and, at the same time, releases the external power applied to the ink injector 90 to inject the supplemental ink. As a result, the supplemental ink injection stops. At this time, the amount of overflow ink should not be in excess of the height H of the overflow ink chamber 63. When the supplemental ink injection stops, the overflow ink that has flown into the overflow ink chamber 63 is again injected into the reservoir 10 through the injection hole 70 by self-gravity. At this time, the injection tube 91 is withdrawn from the injection hole 70.

As described above, when the supplemental ink is injected into the ink cartridge according to the present invention, the injection state of the supplemental ink can be identified by sight so that it can be possible to easily supplement ink by a proper way of injection. As a result, since the inventive ink cartridge prevents the defects of the contemporary cartridge that hands or clothes of the user can be spoiled due to the overflow ink, the present invention promotes reliability with respect to its quality to the consumers while preventing loss or contamination of the supplemental ink.

It will be apparent to those skilled in the art that various modifications and variations can be made in the ink cartridge for ink jet printers of the present invention without departing from the spirit or scope of the invention. Thus, it is intended that the present invention cover the modifications and variations of this invention provided they come within the scope of the appended claims and their equivalents.

What is claimed is:

1. An ink cartridge, comprising:

a reservoir for storing ink for an ink jet printer;

a cap for enclosing a top of said reservoir, said cap having an overflow preventer for surrounding ink overflowing around an injection hole of said overflow preventer and for permitting the ink overflowing around said injection hole to drop through the injection hole into said reservoir, said injection hole for injecting the ink into said reservoir;

an ink reserving elastic member disposed in the reservoir for holding the ink; and an opening plate located below said reservoir, said opening plate having at least one opening for controlling a size of ink drops falling through said at least one opening in said opening plate.

2. The ink cartridge as claimed in claim 1, wherein the overflow preventer in said cap is spaced apart from the ink reserving elastic member in said reservoir.

3. The ink cartridge as claimed in claim 1, wherein the overflow preventer comprises:

a guide tube for guiding an injection tube of an ink injector said ink injector, for injecting ink into said reservoir; and an overflow ink chamber surrounded by the guide tube and for temporarily storing the ink to be dropped through the injection hole into the reservoir under a force of gravity.

4. The ink cartridge as claimed in claim 3, wherein the overflow preventer extends from a top of said cap.

5. The ink cartridge as claimed in claim 3, wherein a height of the guide tube is greater than a width of the guide tube and a height of the overflow ink chamber is greater than a width of the overflow ink chamber.

6. The ink cartridge as claimed in claim 3, wherein the overflow ink chamber has an opening to an exterior of the ink cartridge.

7. The ink cartridge as claimed in claim 1, wherein the overflow preventer extends from a top of said cap.

8. An ink cartridge, comprising:

a reservoir for storing ink; and a cap for enclosing a top of said reservoir, said cap having an overflow preventer for surrounding ink overflowing around an injection hole of said another preventer and for permitting ink overflowing around said injection hole to drop through the injection hole into said reservoir, said injection hole for injecting the ink into said reservoir.

9. The ink cartridge as claimed in claim 8, wherein the overflow preventer comprises:

a guide tube for guiding an injection tube of an ink injector said ink injector, for injecting the ink into said reservoir; and an overflow ink chamber surrounded by the guide tube and for temporarily storing the ink to be dropped through the injection hole into the reservoir.

10. The ink cartridge as claimed in claim 9, wherein the overflow preventer extends from a top of said cap.

11. The ink cartridge as claimed in claim 9, wherein a height of the guide tube is greater than a width of the guide tube and a height of the overflow ink chamber is greater than a width of the overflow ink chamber.

12. The ink cartridge as claimed in claim 9, wherein the overflow ink chamber has an opening to an exterior of the ink cartridge.

13. The ink cartridge as claimed in claim 8, wherein the overflow preventer extends from a top of said cap.

14. An ink cartridge, comprising:

a reservoir for storing ink of an ink jet printer;

a cap for enclosing a top of said reservoir, said cap having an overflow preventer extending from a top of said cap for surrounding the ink overflowing around an injection hole and for permitting the ink overflowing around said injection hole to drop through the injection hole into said reservoir, said injection hole for injecting the ink into said reservoir, the overflow preventer comprising:

a guide tube for guiding an injection tube of an ink injector, said ink injector for injecting ink into said reservoir; and an overflow ink chamber of the overflow preventer surrounded by the guide tube and having an opening to an exterior of the ink cartridge, said overflow ink chamber for temporarily storing the ink to be dropped through the injection hole into the reservoir;

an ink reserving elastic member disposed in the reservoir for holding the ink and spaced apart from the overflow preventer in said cap; and an opening plate located below said reservoir, said opening plate having at least one opening for controlling a size of ink drops falling through said at least one opening in said opening plate.

15. The ink cartridge as claimed in claim 14, wherein a height of the guide tube is greater than a width of the guide tube and a height of the overflow the ink chamber is greater than a width of the overflow ink chamber.

16. The ink cartridge as claimed in claim 14, further comprising a jetting unit for ejecting ink from said reservoir, said jetting unit being positioned at a bottom of said reservoir.

17. The ink cartridge as claimed in claim 16, further comprising a head driver connected to said jetting unit by an electrical connector, said head driver through said electrical connector sending electrical energy to the jetting unit for ejecting the ink from said reservoir in dependence upon data received from a computer.

* * * * *